US005423701A

United States Patent [19]

Rodskier et al.

[11] Patent Number: 5,423,701

[45] Date of Patent: Jun. 13, 1995

[54] PROPELLER ARRANGEMENT FOR A MARINE PROPULSION UNIT

[75] Inventors: Christian Rodskier, Torslanda; Stig Johansson, Gothenburg; Lars-Erik Åkersten, Västra Frölunda, all of Sweden

[73] Assignee: AB Volvo Penta, Gothenburg, Sweden

[21] Appl. No.: 256,779

[22] PCT Filed: Feb. 12, 1993

[86] PCT No.: PCT/SE93/00109

§ 371 Date: Sep. 14, 1994

§ 102(e) Date: Sep. 14, 1994

[87] PCT Pub. No.: WO93/15950

PCT Pub. Date: Aug. 19, 1993

[30] Foreign Application Priority Data

Feb. 12, 1992 [SE] Sweden ..... 9200413-4

[51] Int. Cl.[6] ..... B63H 5/10

[52] U.S. Cl. ..... 440/81; 440/89; 416/93 A

[58] Field of Search ..... 440/49, 53, 75, 80, 440/81, 83, 89; 416/93 A, 129, 128

[56] References Cited

U.S. PATENT DOCUMENTS

| | | | |
|---|---|---|---|
| 2,058,361 | 10/1936 | Sherwood | 416/129 A |
| 4,023,353 | 5/1977 | Hall | 416/93 A |
| 4,540,369 | 9/1985 | Caires | 416/93 A |
| 4,793,773 | 12/1988 | Kinouchi et al. | 416/129 |

*Primary Examiner*—Stephen P. Avila

*Attorney, Agent, or Firm*—Burns, Doane, Swecker & Mathis

[57] ABSTRACT

A double propeller arrangement for a marine propulsion unit, for example of the type which includes a so-called stern-drive. Each propeller has a hub consisting of an inner sleeve with splines for attachment to a propeller shaft, an outer sleeve with propeller blades, and an elastic bushing between the sleeves. Particular to the propeller arrangement is that the inner sleeve of respective propeller hubs is provided with an axial passage for the discharge of exhaust gases from an internal combustion engine connected to the propeller drive.

4 Claims, 2 Drawing Sheets

PROPELLER ARRANGEMENT FOR A MARINE PROPULSION UNIT

The present invention relates to a propeller arrangement for a marine propulsion unit, comprising first and second concentrically supported propeller shafts for rotation in opposite directions, each shaft carrying a propeller hub having a first sleeve member secured to the shaft for rotation therewith, a second sleeve member provided with propeller blades, and a bushing of elastic material disposed between said sleeve members.

Hitherto, propeller arrangements of this type when used in conjunction with marine propulsion units having so-called stern-drive, for example of the Aquamatic © type, have had their exhaust passages from the engine discharge via a cavitation plate positioned above the propellers. Discharge of exhaust gases via the cavitation plate is also used in single propeller drive systems, though with such drive systems it is also common to direct the exhaust gases through exhaust passages in the propeller hub. In such a case, the construction of the hub, as well as its sealing to the drive unit, is somewhat more complicated, though this is offset by the advantage that the exhaust gases from the hub fill out the central cavitation void behind the hub centre which is created during high-speed cruising. This allows the stern cone on the propeller hub to be dispensed with. In addition, a somewhat higher propeller efficiency can be attained, at least in the higher speed range.

However, no-one has yet applied the method of exhausting gases through the propeller hub known for single propellers to a double propeller drive system, since it has generally been considered that any possible advantages would be outweighed by the disadvantages associated with increased costs due to the more complicated construction of the double propeller drive, etc.

It is therefore a general object of the present invention to provide a propeller arrangement of the type mentioned in the introduction, which provides an increase in efficiency at least in the higher speed range when compared to conventional double propeller systems, though which is not prohibitively expensive.

This object is achieved in accordance with the present invention by means of the propeller hubs being provided with at least one axial passage for the discharge of exhaust gases from an internal combustion engine forming a part of the propulsion unit.

It has been shown that exhaust gas discharge via the propeller hubs in a double propeller system provides an increase in the total efficiency of the propeller arrangement which is greater than what could be expected in view of that which is achieved with single propeller systems, and that this result can be achieved using a relatively uncomplicated construction.

In known single propellers with exhaust gas discharge through the hub, the exhaust passage is arranged between the outer hub sleeve which carries the propeller blades and the inner sleeve member. Such an arrangement can lead to problems with the front propeller due to the relatively large diameter of the tubular shaft. Depending on the material of the hub, there is a risk that the hub sleeve casting be too thin when employing presently specified sizes of exhaust passages and radius of the propeller blade intersection surface.

In a preferred embodiment of the invention, the exhaust passage is arranged in an inner sleeve member.

The inner sleeve member includes an inner sleeve that is shaped with inwardly directed grooves and splines for engagement with corresponding grooves and splines on the propeller shaft, as well as an outer sleeve which is concentric with, and spaced from, the inner sleeve, the spacing forming an exhaust passage which is divided into several axial channels by wall elements which unite the outer and inner sleeves.

By arranging the exhaust passage in the sleeve member radially inwardly with respect to the rubber bushing, the outer sleeve which carries the propeller blades can be sized and cast with sufficient wall thickness. At the same time, the rubber bushing retains its large diameter and optimal adhesion surface area for attachment to the surfaces of the hub sleeves.

The invention will be described in greater detail with reference to the embodiment shown in the attached drawings, in which FIG. 1 is a longitudinal sectional view of a propeller arrangement according to the invention and its communication with the lower stern region of a stern-drive unit;

Figure 1:
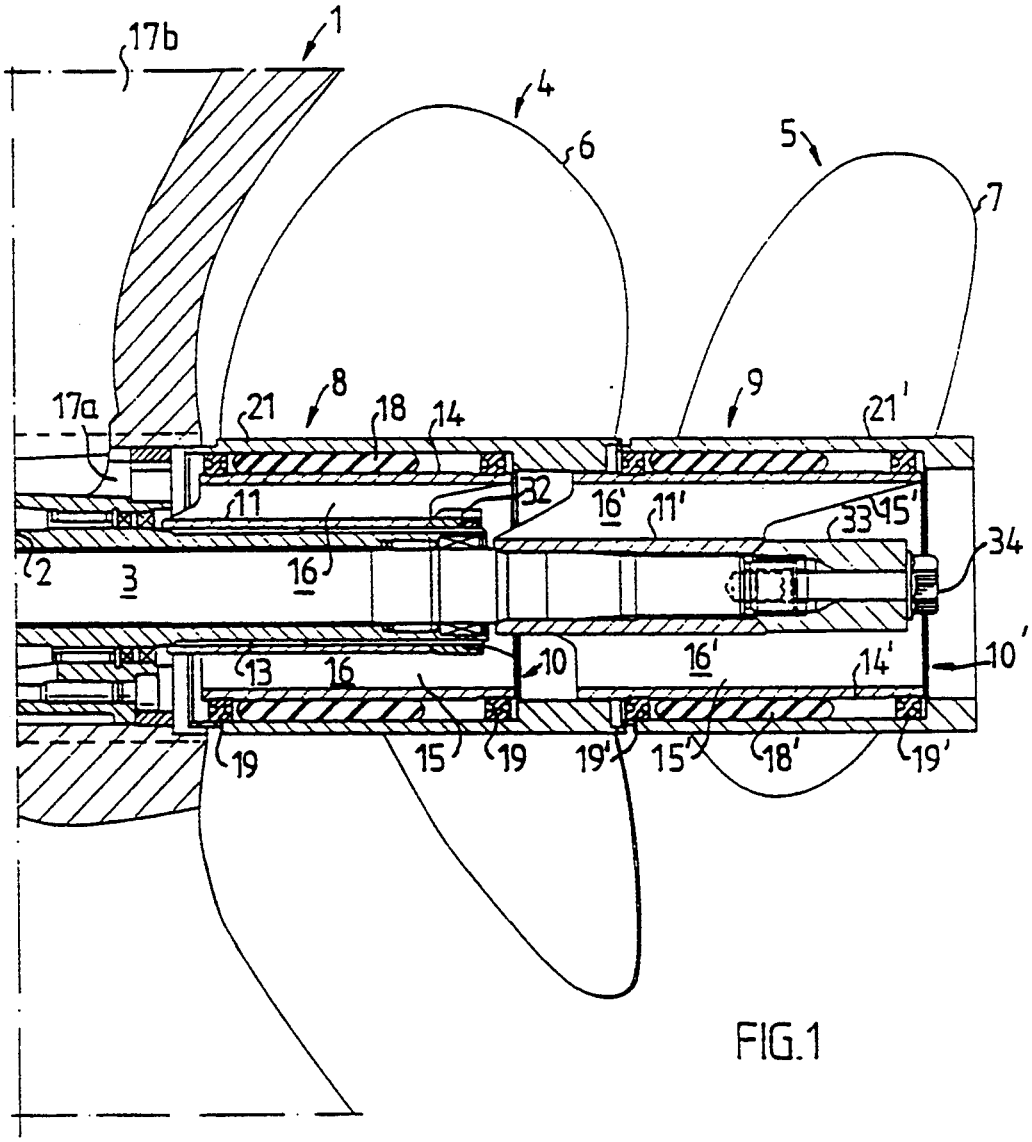
Figure 2:
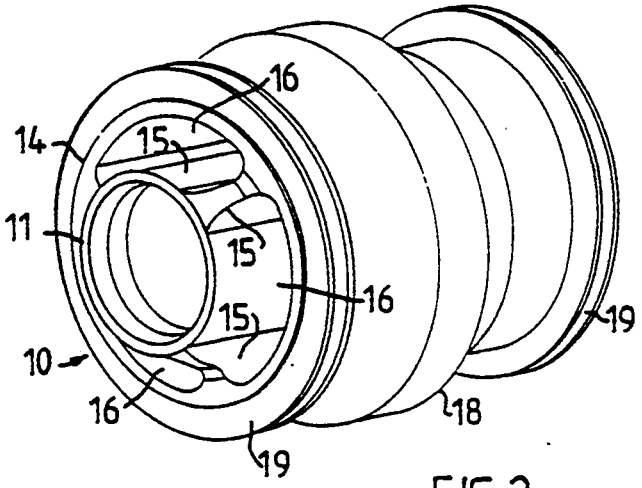
FIG. 2 is a perspective view of the inner sleeve member of respective propeller hubs.
Figure 3:
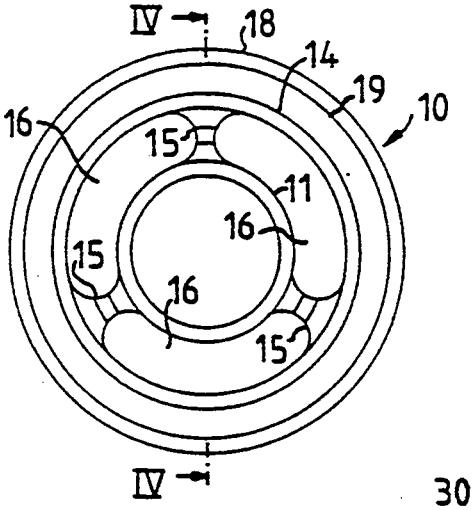
FIG. 3 is an end view of the sleeve member shown in FIG. 2.

In FIG. 1, reference numeral 1 denotes a lower wall region of a stern-drive unit, for example of the Aquamatic © type, which is connected to a not-shown internal combustion engine. A first tubular propeller shaft 2 and a second propeller shaft 3 are concentrically rotatably supported in the drive unit and connected to a drive shaft in a known manner via a not-shown conical gear arrangement so as to be driven in opposite directions. Each propeller shaft 2 and 3 carries a propeller, generally denoted by 4 and 5 respectively, which comprises blades 6 and 7 resp. and a hub 8 and 9 resp.

The propeller hub 8 presents an inner sleeve member 10 which consists of an inner sleeve 11 and an outer sleeve 14. The inner sleeve 11 has internal splines 12 for engagement with corresponding external splines 13 on the tubular shaft 2 and is connected to the outer sleeve 14 via axial wall elements or webs 15. The sleeves 11, 14 and the webs 15 together delimit three exhaust channels 16 which communicate with an exhaust pipe **17*b* in the drive unit via an opening 17*a* in the wall region 1 concentric with the propeller shafts 2, 3**.

Figure 4:
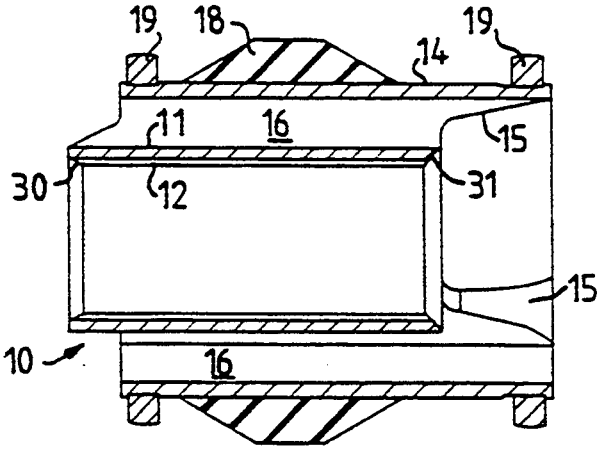
FIG. 4 is a section along line IV—IV in FIG. 3.

The described sleeve member 11 can be produced by extrusion in long lengths which are then cut to the actual hub length. A rubber bushing 18 is cured or adhered to the outer surface of the outer sleeve 14 and a pair of spacer rings 19 of a relatively hard plastic material are affixed to the sleeve 14, with one ring 19 to each side of the bushing 18. The position of the spacer rings 19 is determined by shallow circumferential grooves 20 in which the rings sit. The outer diameter of the distance rings 19 is equal to the inner diameter of the outer sleeve member 21 to which the propeller blades 6 are affixed. As is apparent from FIG. 4, in its non-influenced state, the outer diameter of the bushing 18 is greater than the diameter of the spacer rings 19. During assembly of the hub sleeves 10 and 21, the bushing 18 is compressed so that it thereby expands axially, as illustrated in FIG. 1. The bushing 18 is fixedly adhered or cured to the outer sleeve 21 and serves as a torsion member, whilst the distance rings 19 take up radial loads and prevent the outer sleeve 21 with the blades 6 from "wobbling".

The propeller hub 9 is constructed in the same manner as the hub 8 and corresponding components have been denoted by the same reference numeral, though with the addition of a prime. A few minor differences can be identified; for example, the sleeve member 10 is shorter than the sleeve member 10' and the inner sleeve 11 does of course have a greater inner diameter than the sleeve 11' to allow it to be slid onto the tubular shaft 2.

The inner sleeves 11, 11' have conical end surfaces 30 and 31 (see particularly FIG. 4) and are clamped between conical surfaces on respective shafts 2, 3 and lock nuts 33, 34, of which the lock nut 33 is secured by a bolt 34 which is screwed into a threaded bore in the end of the shaft 3.

As previously mentioned, the described embodiment lends itself to be produced from extruded aluminium. Thanks to the rubber bushing 18 and spacer ring arrangement, the outer sleeve 21 with the propeller blades is electrically insulated, which implies that materials other than aluminium can be used in the outer sleeve 21, for example stainless steel, without the risk of galvanic corrosion.

We claim:

1. A propeller arrangement for a marine propulsion unit, comprising;

first and second concentrically supported propeller shafts for rotation in opposite directions, each shaft carrying a propeller hub having a first sleeve member secured to the shaft for rotation therewith, a second sleeve member provided with propeller blades, and a bushing of elastic material disposed between said sleeve members, the propeller hubs are provided with at least one axial passage for the discharge of exhaust gases from an internal combustion engine forming a part of the propulsion unit, and the exhaust passage is arranged in the inner sleeve member.

2. Propeller arrangement according to claim 1, wherein the inner sleeve member includes an inner sleeve that is provided with inwardly directed grooves and splines for engagement with corresponding grooves and splines on the propeller shaft, as well as an outer sleeve which is concentric with, and spaced from, the inner sleeve, the spacing forming the exhaust passage which is divided into several axial channels by wall elements which join the outer and inner sleeves together.

3. Propeller arrangement according to claim 1, wherein the first and second sleeve members are radially fixed relative to each other by means of a pair of non-metallic spacer rings arranged one on either side of the elastic bushing.

4. Propeller arrangement according to claim 3, wherein the spacer rings are made from plastic.

* * * * *